US008314539B2

(12) United States Patent
Son et al.

(10) Patent No.: US 8,314,539 B2
(45) Date of Patent: Nov. 20, 2012

(54) FIELD ELECTRON EMITTER INCLUDING NUCLEIC ACID-COATED CARBON NANOTUBE AND METHOD OF MANUFACTURING THE SAME

(75) Inventors: Yoon-chul Son, Hwaseong-si (KR); Yong-chul Kim, Seoul (KR); Jeong-na Heo, Yongin-si (KR); Byeong-kwon Ju, Seoul (KR)

(73) Assignees: Samsung Electronics Co., Ltd. (KR); Korea University Industrial & Academic Collaboration Foundation (KR)

( * ) Notice: Subject to any disclaimer, the term of this patent is extended or adjusted under 35 U.S.C. 154(b) by 151 days.

(21) Appl. No.: 12/533,144

(22) Filed: Jul. 31, 2009

(65) Prior Publication Data

US 2010/0181894 A1 Jul. 22, 2010

(30) Foreign Application Priority Data

Jan. 22, 2009 (KR) ..... 10-2009-0005568

(51) Int. Cl.
*H01J 1/00* (2006.01)
*H01J 9/00* (2006.01)

(52) U.S. Cl. ..... 313/311; 438/20; 313/310; 313/495; 427/77; 427/78; 445/50; 445/51

(58) Field of Classification Search ..... 313/414, 313/441–460, 495–497, 293–304, 306, 309–310, 313/346, 351, 355; 438/20
See application file for complete search history.

(56) References Cited

U.S. PATENT DOCUMENTS

| | | | | |
|---|---|---|---|---|
| 6,436,221 | B1 * | 8/2002 | Chang et al. | 156/247 |
| 2005/0009039 | A1 * | 1/2005 | Jagota et al. | 435/6 |
| 2007/0024177 | A1 * | 2/2007 | Choi et al. | 313/495 |
| 2007/0236126 | A1 * | 10/2007 | Wei et al. | 313/311 |
| 2008/0012461 | A1 * | 1/2008 | Yaniv et al. | 313/309 |
| 2009/0057623 | A1 * | 3/2009 | Cha et al. | 252/506 |
| 2009/0098671 | A1 * | 4/2009 | Kim et al. | 438/20 |
| 2009/0160306 | A1 * | 6/2009 | Xiao et al. | 313/310 |
| 2010/0044233 | A1 * | 2/2010 | Zheng et al. | 205/50 |
| 2010/0301734 | A1 * | 12/2010 | Suh et al. | 313/310 |

FOREIGN PATENT DOCUMENTS

| | | | |
|---|---|---|---|
| JP | 2005-101363 | A | 4/2005 |
| KR | 1020040075620 | A | 8/2004 |
| KR | 1020050044164 | A | 5/2005 |
| KR | 1020070001405 | A | 1/2007 |
| KR | 1020070001769 | A | 1/2007 |
| KR | 1020080084461 | A | 9/2008 |
| WO | 02/079514 | A1 | 10/2002 |

OTHER PUBLICATIONS

Ming Zheng, "DNA-Carbon Nanotube Interactions: Fundamentals and Applications", National Institute of Standards and Technology, Gaithersburg, MD 20899, pp. 1-26.
Ming Zheng, "DNA-assisted dispersion and separation of carbon nanotubes" Nature Publishing Group, vol. 2, May 2003, www.nature.com/naturematerials pp. 338-342.
Ming Zeng, Structure-Based Carbon nanotube sorting by sequence-Dependent DNA Assembly, Science 302, 1545 (2003).

* cited by examiner

*Primary Examiner* — Mariceli Santiago
*Assistant Examiner* — Donald Raleigh
(74) *Attorney, Agent, or Firm* — Cantor Colburn LLP

(57) ABSTRACT

A field electron emitter includes a thin film layer including a carbon nanotube ("CNT") disposed on a substrate, wherein the thin film layer includes nucleic acid.

20 Claims, 6 Drawing Sheets

FIELD ELECTRON EMITTER INCLUDING NUCLEIC ACID-COATED CARBON NANOTUBE AND METHOD OF MANUFACTURING THE SAME

CROSS-REFERENCE TO RELATED APPLICATION

This application claims priority to Korean Patent Application No. 10-2009-0005568, filed on Jan. 22, 2009, and all the benefits accruing therefrom under 35 U.S.C. §119, the contents of which in its entirety are herein incorporated by reference.

BACKGROUND

1. Field

One or more exemplary embodiments relate to a field electron emitter including a nucleic acid-coated carbon nanotube ("CNT") and a method of manufacturing the same.

2. Description of the Related Art

Research on field emission was begun by the Stanford Research Institute, from which electron beam micro-devices based on field emission arrays has been introduced and realized. A Spindt-type field emitter, which is a basis of typical field emission displays ("FEDs"), includes a micro-sized field emission tip and an anode, to which a gate electrode and a fluorescent substance for collecting emitted electrons are applied, wherein the field emission tip is formed on a cathode. Research is being conducted into replacing a molybdenum (Mo) tip that is typically used in the FED with a CNT.

In order to manufacture a field electron emitter using a carbon nanotube ("CNT"), a cathode is first deposited and then a CNT is deposited on the cathode or is printed on the cathode using CNT paste. Since it is difficult to deposit a CNT each time using chemical vapor deposition ("CVD") and a patterning process is also difficult to perform, the use CNT paste is predominant. The cathode may be formed using two methods: one is using vacuum deposition equipment or a general photolithography process to deposit Cr or Mo, and the other is stencil printing a material such as Ag and then calcinating the printed material. In the former case, the vacuum deposition equipment process is complicated and in the latter case, raw materials are expensive and thus a manufacturing cost is high. The CNT paste is printed and is calcinated at a high temperature of 400° C. to 500° C. Then, the CNT on the surface is activated and thus the CNT may be used as a field electron emitter. As another method, the CNT, which appeared on the resulting surface by dispersing the CNT in a copper plating solution and plating depositing the copper plating solution and the CNT together, may be used as a field emitter tip, or alternatively an indium layer is deposited on an ITO electrode and the CNT is dispersed on the deposited indium layer and then is heat treated so that the CNT is embedded in the indium layer, thereby forming a field electron emitter.

SUMMARY

One or more exemplary embodiments include a field electron emitter including a thin film layer having a carbon nanotube ("CNT"), wherein the thin film layer includes nucleic acid.

One or more exemplary embodiments include a field electron emission device including the exemplary embodiment of a field electron emitter.

One or more exemplary embodiments include a method of manufacturing the exemplary embodiment of a field electron emitter.

Additional aspects will be set forth in part in the description which follows and, in part, will be apparent from the description, or may be learned by practice of the presented exemplary embodiments.

To achieve the above and/or other aspects, one or more exemplary embodiments may include a field electron emitter including; a thin film layer including the CNT disposed on a substrate, wherein the thin film layer includes nucleic acid.

In one exemplary embodiment, at least a portion of the CNT may be coated with the nucleic acid.

In one exemplary embodiment, the nucleic acid may be coated on the CNT by a π-π stacking interaction between the nucleic acid and the CNT.

In one exemplary embodiment, the substrate may be a conductive transparent substrate.

In one exemplary embodiment, the substrate may include a material selected from the group consisting of indium tin oxide (ITO), aluminum-doped zinc oxide, zinc-doped indium oxide, gallium indium oxide, and any mixtures thereof.

In one exemplary embodiment, the nucleic acid may be deoxyribonucleic acid ("DNA"), ribonucleic acid ("RNA"), pentose nucleic acid ("PNA"), or any mixtures thereof.

In one exemplary embodiment, the nucleic acid may be one of single-strand nucleic acid and double-strand nucleic acid.

In one exemplary embodiment, the nucleic acid may be only coated on the CNT on the interface between the thin film layer and the substrate.

To achieve the above and/or other aspects, one or more exemplary embodiments may include a field electron emission device including the exemplary embodiment of a field electron emitter described above.

To achieve the above and/or other aspects, one or more exemplary embodiments may include an exemplary embodiment of a method of manufacturing a field electron emitter, the method including; coating the CNT aqueous dispersion on a substrate, and drying the coated CNT aqueous dispersion, wherein the CNT aqueous dispersion includes CNTs and nucleic acid.

In one exemplary embodiment, at least a portion of the CNTs dispersed from the CNT aqueous dispersion may be coated with the nucleic acid.

In one exemplary embodiment, the substrate may be a conductive transparent substrate.

In one exemplary embodiment, the substrate may include a material selected from the group consisting of ITO, aluminum-doped zinc oxide, zinc doped indium oxide, gallium indium oxide, and any mixtures thereof.

In one exemplary embodiment, the nucleic acid may be DNA, RNA, PNA, or any mixtures thereof.

In one exemplary embodiment, the nucleic acid may be one of single-strand nucleic acid and double-strand nucleic acid.

In one exemplary embodiment, the CNT aqueous dispersion may be manufactured using a method including; adding nucleic acid and CNT to a solvent to form a solution, and ultrasonic processing the solution in which the nucleic acid and the CNT are included.

In one exemplary embodiment, the nucleic acid and the CNTs may be added by a weight ratio of about 1:1 to about 10:1.

In one exemplary embodiment, the method may further include activating a dried CNT-coated layer, after the drying of the coated CNT aqueous dispersion.

In one exemplary embodiment, the activating a dried CNT-coated layer may include removing the nucleic acid coated on the CNT except for the nucleic acid between the CNT and substrate using an etching process.

In one exemplary embodiment, the activating a dried CNT-coated layer may include a taping process.

In one exemplary embodiment, the method may further include separating only the nucleic acid-coated CNT from the CNT aqueous dispersion, before coating the CNT aqueous dispersion on the substrate.

In one exemplary embodiment, the nucleic acid-coated CNT may be separated by at least one of centrifugation, precipitation, and drying.

BRIEF DESCRIPTION OF THE DRAWINGS

The above and/or other aspects, advantages and features of the exemplary embodiments will become apparent and more readily appreciated from the following description of the exemplary embodiments, taken in conjunction with the accompanying drawings, of which.

DETAILED DESCRIPTION

Figure 1:
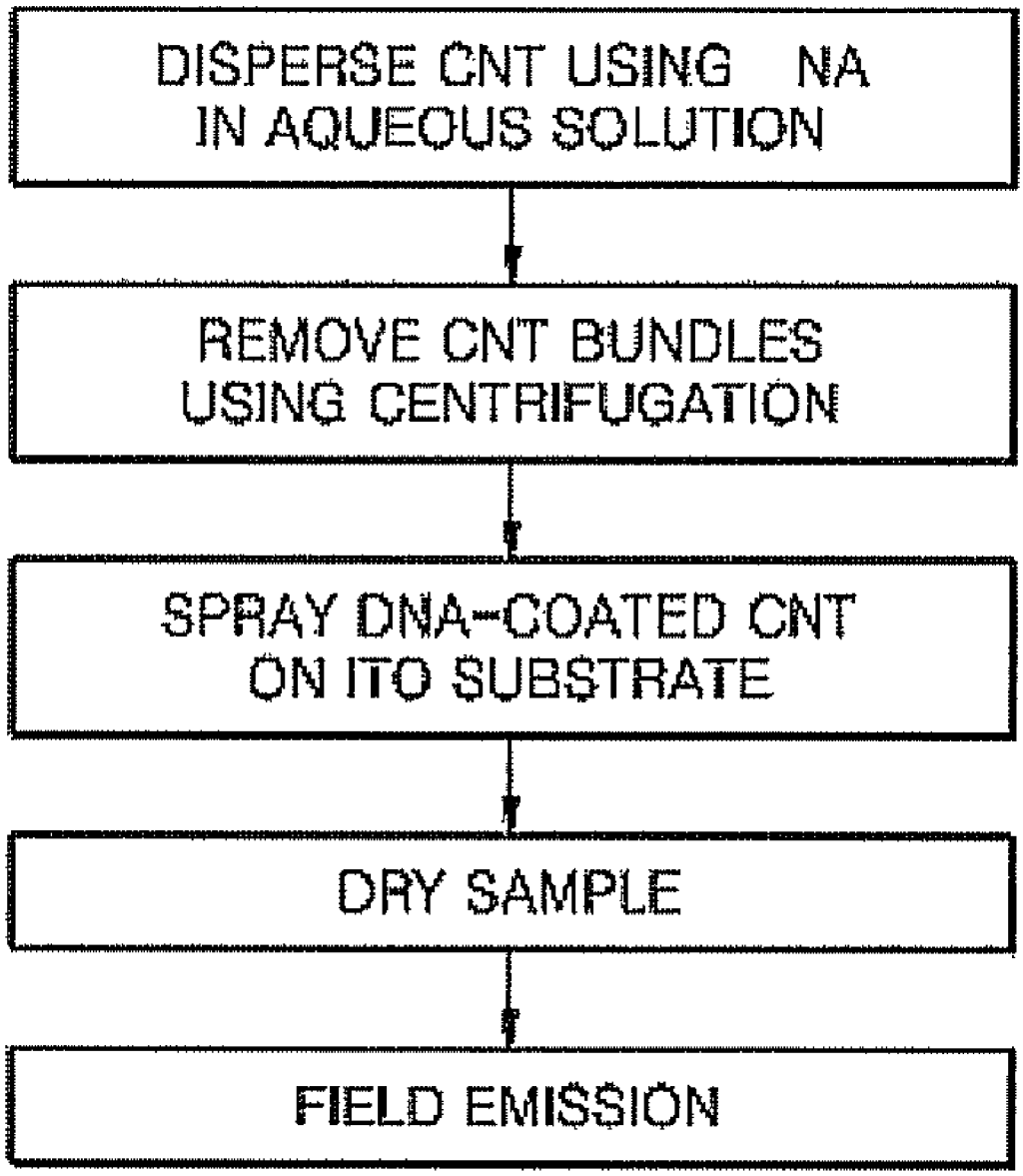
FIG. 1 is a flowchart illustrating an exemplary embodiment of a method of manufacturing an exemplary embodiment of a field electron emitter.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, one or more exemplary embodiments will be described more fully with reference to the accompanying drawings.

An exemplary embodiment of a field electron emitter includes a thin film layer that includes a carbon nanotube ("CNT") disposed on a substrate, wherein the thin film layer includes nucleic acid. Exemplary embodiments include configurations wherein only a portion of the CNT may be coated with nucleic acid or the entire CNT may be coated with the nucleic acid.

The present exemplary embodiment of a field electron emitter may be manufactured by dispersing the nucleic acid-coated CNT such as Deoxyribonucleic acid ("DNA"), Ribonucleic acid ("RNA"), or pentose nucleic acid ("PNA") directly on an indium tin oxide ("ITO") electrode surface and drying the substrate, instead of further depositing a layer on the ITO electrode. The exemplary embodiment of a method of manufacturing the field electron emitter will be described in more detail later.

The CNT has a high aspect ratio and excellent electrical characteristics and thus is suitable for use as a field emission tip in a field emission display ("FED"). Typically a metal electrode is first deposited and then the CNT is grown on the metal electrode, or alternatively, CNT paste is printed on the metal electrode, thereby manufacturing a field emission tip. However, according to the present exemplary embodiment, the nucleic acid (DNA, RNA, or PNA)-coated CNTs dispersed in a solution are sprayed on the ITO electrode surface and then the ITO electrode surface is dried, thereby simply manufacturing a field emission tip. The present exemplary embodiment may be applied to various fields involving field emission such as FEDs, surface light sources of liquid crystal display ("LCD") backlight units, X-ray sources for medical images and other similar devices.

Moreover, CNTs have excellent electrical and thermal characteristics and great hardness and intensity in a mechanical point of view and thus are being studied for application to various fields. One of the complications of using CNTs is that when CNTs are generated using chemical vapor deposition ("CVD"), the CNTs are attracted to each other due to the van der Waals force and thus bundle together so that the CNTs may be difficult to separate from each other. In order to separate the CNTs, various dispersants may be used. Exemplary embodiments of the dispersants may include dispersants having negative electric charges such as sodium dodecyl sulfate, sodium dodecylbenzenesulfonate, and dioctyl sulfosuccinate, and dispersants having positive electric charges such as cetyltrimethylammonium bromide and cetylpyridinium chloride. Since DNA, RNA or PNA are absorbed and coated on the surfaces of the CNTs in the present exemplary embodiment and the CNTs have been found to be easily separated, research regarding this characteristic is being conducted. Without being bound by theory, it appears that such a phenomenon occurs by a π-π stacking interaction, e.g., an aromatic interaction, between a DNA base and a CNT sidewall and a reaction in which DNA spontaneously surrounds a CNT. Due to the π-π stacking interaction between nucleic acid and the CNT, nucleic acid may be coated on the CNT.

The nucleic acid included in the present exemplary embodiment of a field electron emitter may be coated on the surface of the CNT by the π-π stacking interaction between the nucleic acid and the CNT.

According to the present exemplary embodiment, the substrate may be a conductive transparent substrate and may include a material selected from the group consisting of ITO, aluminum-doped zinc oxide, zinc-doped indium oxide, gallium indium oxide, and other materials having similar characteristics. For example, in one exemplary embodiment, adhesion between ITO and the nucleic acid is excellent and is described more fully with reference to the Examples below, where the ITO is widely used as a material for a display electrode since the ITO is an inorganic material which is both conductive and transparent.

According to the present exemplary embodiment, the nucleic acid may be DNA, RNA, or PNA. Exemplary embodiments include configurations wherein the nucleic acid may be separated from natural nucleic acid but may be synthesized or semi-synthesized. The nucleic acid may be single-strand nucleic acid or double-strand nucleic acid. For example, in one exemplary embodiment, the nucleic acid may be transfer RNA ("tRNA"). The nucleic acid may be heat treated in order to, for example, remove a secondary or tertiary structure in a molecule.

The CNT may be at least one selected from the group consisting of a single-wall CNT, a double-wall CNT, a multi-wall CNT, a chemically modified CNT, a metal CNT, a semiconductor CNT, a metallized CNT and any mixtures thereof.

The weight ratio of the CNT and the nucleic acid may be from about 1:1 to about 10:1.

In consideration of the dispersion degree of the CNT, an amount of the recovered CNT, adhesion between the substrate and the CNT, and the field emission effect, the above weight ratio range of the CNT and the nucleic acid is appropriate.

According to the present exemplary embodiment, only the CNT on the interface between a CNT thin film layer and the substrate may be coated with the nucleic acid. When the CNT is activated as described above, the nucleic acid exists between the substrate and the CNT so that adhesion between the substrate and the CNT is maintained and the field emission effect may be improved.

Figure 2:
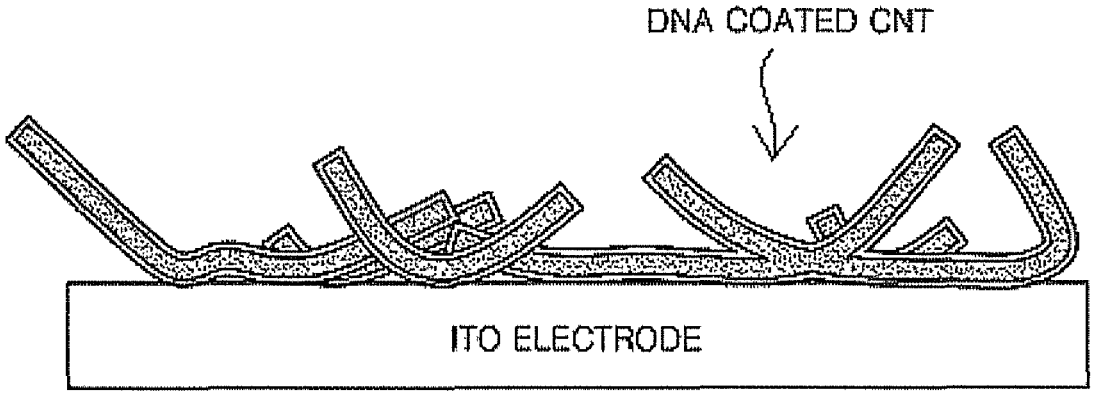
FIG. 2 is a diagram of an exemplary embodiment of a field electron emitter.

FIG. 2 is a diagram of an exemplary embodiment of a field electron emitter.

Referring to FIG. 2, DNA-coated CNTs are firmly attached on an ITO substrate, thereby forming the field electron emitter. Adhesion between the DNA-coated CNTs and the ITO substrate will be described in more detail later.

The field electron emitter of FIG. 2 may be used in a field electron emission device and electrons may be emitted by the field electron emitter. However, when the electron emission effect is low, the nucleic acid on the upper part of the nucleic acid-coated CNT may be removed. Here, when the nucleic acid between the CNT and the ITO substrate is removed, interface adhesion is reduced. Therefore, in the present exemplary embodiment the nucleic acid between the CNT and the substrate is retained. An appropriate calcinating process at a high temperature or an etching process such as oxygen plasma treatment are used to burn and/or remove the remaining nucleic acid, except for the nucleic acid between the CNT and the substrate. The methods of removing the nucleic acid are not limited thereto.

Figure 3:
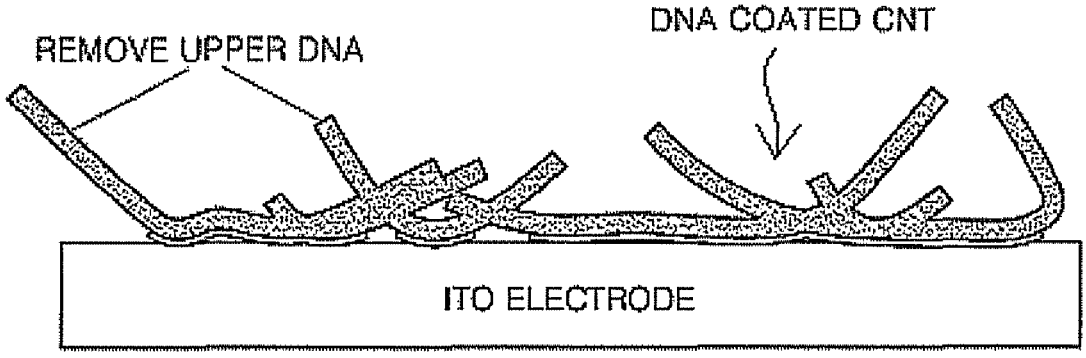
FIG. 3 is a diagram of an exemplary embodiment of a field electron emitter in which nucleic acid remains only between a carbon nanotube ("CNT") and a substrate and other nucleic acid coated on the CNT is removed.

The field electron emitter, in which the nucleic acid on the upper part of the nucleic acid-coated CNT is removed, is illustrated in FIG. 3.

Figure 9:
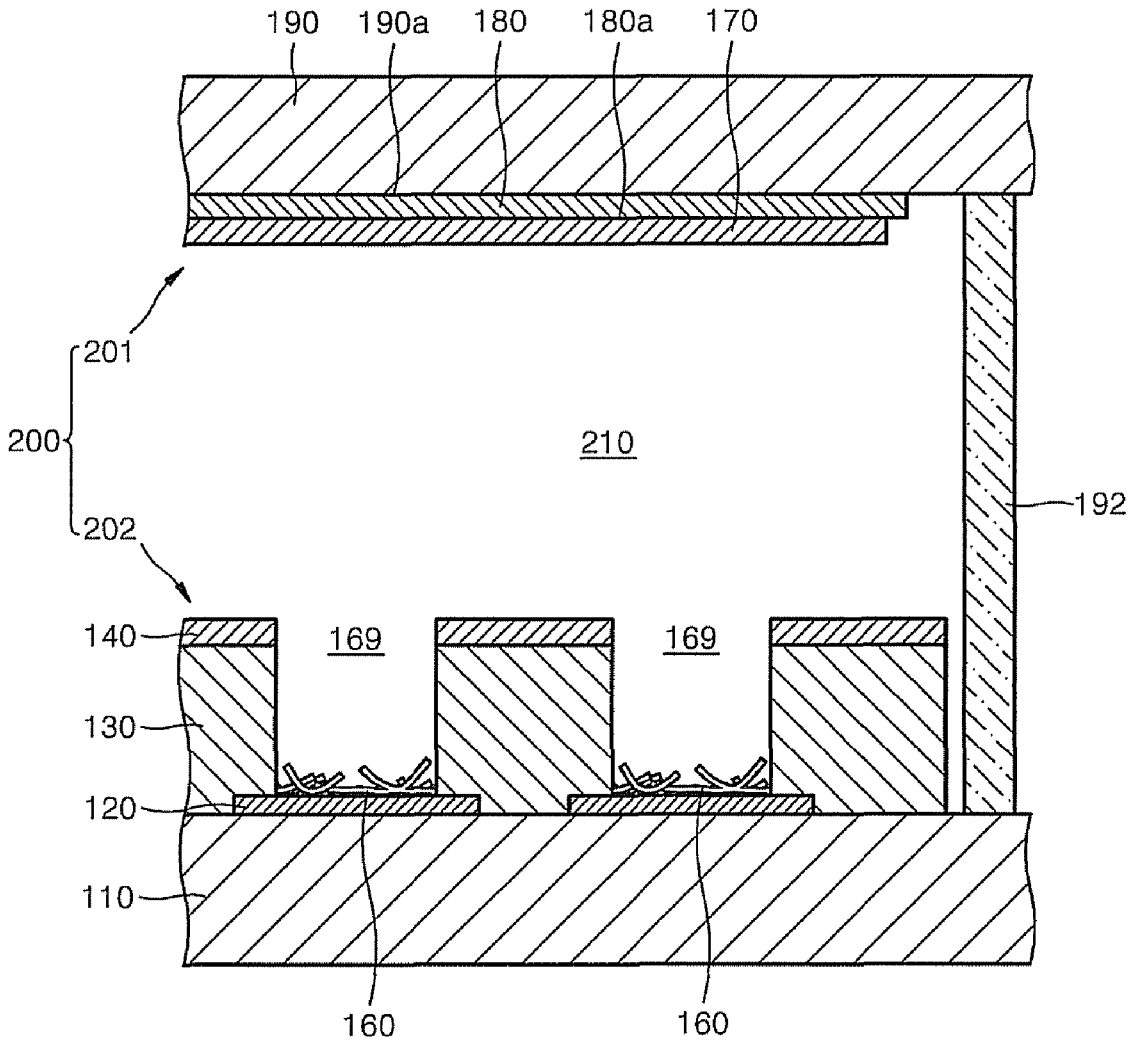
FIG. 9 is a diagram illustrating an exemplary embodiment of a field electron emission device including the exemplary embodiment of a field electron emitter of FIG. 2.

FIG. 9 is a diagram illustrating an exemplary embodiment of a field electron emission device 200 including the exemplary embodiment of a field electron emitter of FIG. 2.

Referring to FIG. 9, the field electron emission device 200 has a triode structure. The field electron emission device 200 includes an upper substrate 201 and a lower substrate 202, wherein the upper substrate 201 includes an upper side substrate 190, an anode electrode 180 disposed on a lower surface 190A of the upper side substrate 190, and a phosphor layer 170 disposed on a lower surface 180A of the anode electrode 180.

The lower substrate 202 includes a lower side substrate 110, at least one field cathode electrode 120, at least one gate electrode 140, an insulator layer 130, at least one field emitter hole 169, and at least one field emitter, wherein the lower side substrate 110 is spaced apart from the upper side substrate 190 by a predetermined interval so as to have a inner space between the lower substrate 202 and the upper substrate 201 and is disposed to face and be substantially parallel to the upper side substrate 190. In the present exemplary embodiment the cathode electrode 120 is disposed on the lower side substrate 110 in a strip form, the gate electrode 140 is disposed in a strip form to be substantially perpendicular to the cathode electrode 120, the insulator layer 130 is interposed between the gate electrode 140 and the cathode electrode 120, the field emitter hole 169 is formed in gaps between adjacent sections of the insulator layer 130 and the gate electrode 140, and the field emitter 160 is disposed within the field emitter hole 169 such that the field emitter 160 is disposed on the cathode electrode 120, communicates with the cathode electrode 120, and is disposed lower in height with respect to the upper substrate 201 than the gate electrode 140. The detailed description of the field emitter 160 is as provided above with respect to FIGS. 1 and 2.

In one exemplary embodiment, the cathode electrode 120 may be a transparent electrode including a material such as ITO, aluminum-doped zinc oxide, zinc-doped indium oxide, gallium indium oxide or other materials having similar characteristics.

In addition, ITO, aluminum-doped zinc oxide, zinc-doped indium oxide, gallium indium oxide or other materials having similar characteristics may be included in the lower side substrate 110, instead of, or in addition to, being included in the cathode electrode 120.

The upper substrate 201 and the lower substrate 202 are retained in a vacuum having a lower pressure than atmospheric pressure. A spacer 192 is interposed between the upper substrate 201 and the lower substrate 202, supports the upper substrate 201 and the lower substrate 202, and defines a light emitting space 210.

The anode electrode 180 applies a high voltage to accelerate electrons from the field emitter 160 towards the anode electrode 180 so that the electrons rapidly collide on the phosphor layer 170. The electrons excite fluorescent materials in the phosphor layer 170, and fall from a high energy level to a low energy level, thereby emitting visible light.

The gate electrode 140 facilitates the electrons to be emitted from the field emitter 160 and the insulator layer 130 partitions the field emitter hole 169 and insulates the field emitter 160 from the gate electrode 140.

The above described exemplary embodiment of a field electron emission device 200 has a triode structure as illustrated in FIG. 9. However, alternative exemplary embodiments of the field electron emission device 200 may have other structures including a diode structure. In addition, exemplary embodiments of the field electron emission device 200 include configurations wherein a field electron emission device, in which a gate electrode is disposed lower than a cathode electrode, or a field electron emission device, in which damage of a gate electrode and/or a cathode electrode due to arc discharge is prevented and a grid/mesh for compensating for the collection of electrons emitted from a field emitter is included. Moreover, the present exemplary embodiment of a field electron emission device 200 may also be incorporated into other display devices, backlight units, X-ray sources for medical images, or other similar devices.

An exemplary embodiment of a method of manufacturing an exemplary embodiment of a field electron emitter will now be described.

The present exemplary embodiment of a method of manufacturing the field electron emitter includes coating a CNT aqueous dispersion on a substrate and drying the coated CNT aqueous dispersion, wherein the CNT aqueous dispersion includes the CNT and nucleic acid.

According to an exemplary embodiment, a part of or the entire CNT dispersed from the CNT aqueous dispersion may be coated with the nucleic acid. The description of the substrate and the nucleic acid is substantially similar to that described above and thus is omitted.

FIG. 1 is a flowchart illustrating the exemplary embodiment of a method of manufacturing the exemplary embodiment of a field electron emitter.

Referring to FIG. 1, CNTs are dispersed using the nucleic acid in an aqueous solution, then bundles of non-dispersed CNTs are removed, e.g., by using centrifugation, the nucleic acid-coated CNT aqueous dispersion is sprayed on the substrate, and the substrate is dried, thereby manufacturing the exemplary embodiment of a field electron emitter.

Exemplary embodiments of the CNT aqueous dispersion may include water or buffer. Exemplary embodiments of the buffer may include a Tris/acetic acid/EDTA ("TAE") buffer, a Tris/Borate/EDTA buffer, and a phosphate-buffered saline ("PBS") buffer. The TAE buffer may include Tris, acetic acid, and EDTA respectively having concentrations of about 4 mM to about 20 mM, about 1.8 mM to about 9 mM, and about 1 mM to about 5 mM.

According to the present exemplary embodiment, the CNT aqueous dispersion may be manufactured using a method including: adding the nucleic acid and CNT to a solvent to form a solution; and ultrasonically processing the solution in which the nucleic acid and the CNT are included.

According to the present exemplary embodiment, the weight ratio of the CNT and the nucleic acid may be about 1:1 to about 10:1.

In consideration of the dispersion degree of the CNT, an amount of the collected CNT, adhesion between the substrate and the CNT, and the field emission effect, the above weight ratio range of the CNT and the nucleic acid is appropriate.

According to the present exemplary embodiment, the method may further include activating a CNT-coated layer that is dried, after the drying of the coated CNT aqueous dispersion. For example, in one exemplary embodiment the activating process may include removing the nucleic acid coated on the CNT except for the nucleic acid between the CNT and substrate using an etching process, or tapping.

According to the present exemplary embodiment, before coating the CNT aqueous dispersion on the substrate, the method may further include separating only the nucleic acid-coated CNT from the CNT aqueous dispersion using, for example, centrifugation, precipitation, drying or other similar methods.

Hereinafter, one or more exemplary embodiments will be described in greater detail with reference to the following examples, which are for illustrative purposes and are not intended to limit the scope of the exemplary embodiments.

Example 1

Surface observation using a scanning electron microscope ("SEM").

In Example 1, 80 mg of a single-wall CNT (Hipco, purity 95%) and 40 mg of tRNA were diluted in 200 ml of deionized water ("DI water"). The RNA-CNT solution was again centrifugally separated at 5000 rpm (1868 G) and thus non-dispersed CNT bundles were further removed from the RNA-CNT solution. The final RNA-CNT solution was sprayed on the surface of an ITO substrate and the surface of the ITO substrate was observed using a field emission ("FE")-SEM.

Figure 5:
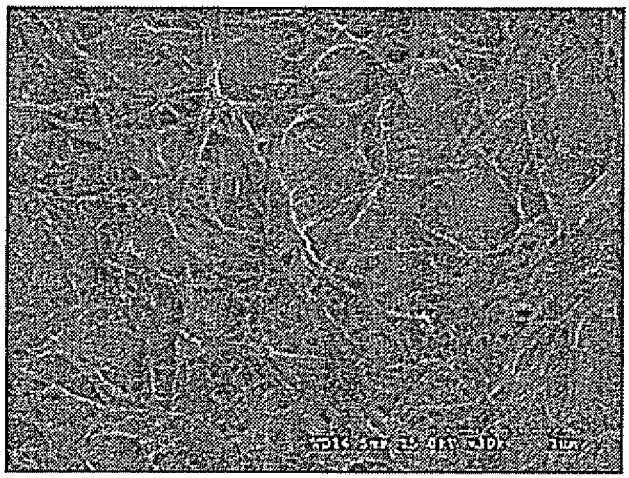
FIG. 5 is an illustration of a tRNA-coated CNT dispersed and attached on a surface of an indium tin oxide ("ITO") substrate taken using a scanning electron microscope ("SEM")

FIG. 5 is an illustration of tRNA-coated CNTs dispersed and attached on the surface of an ITO substrate taken using a SEM. Referring to FIG. 5, the tRNA-coated CNTs are uniformly dispersed on the surface of the ITO substrate.

In an adhesion test, 80 mg of a single-wall CNT (Hipco, purity 95%) and 40 mg of tRNA are diluted in 200 ml of DI water. A diluted solution, in which CNTs are coated on tRNA and were dispersed, was applied to the ITO substrate using a spuit and the ITO substrate was sufficiently dried at 95° C., thereby effectively completely removing moisture. Such a sample was immersed in an acetic acid and then an ultrasonic process was performed on the acetic acid for 20 minutes.

Figure 4:
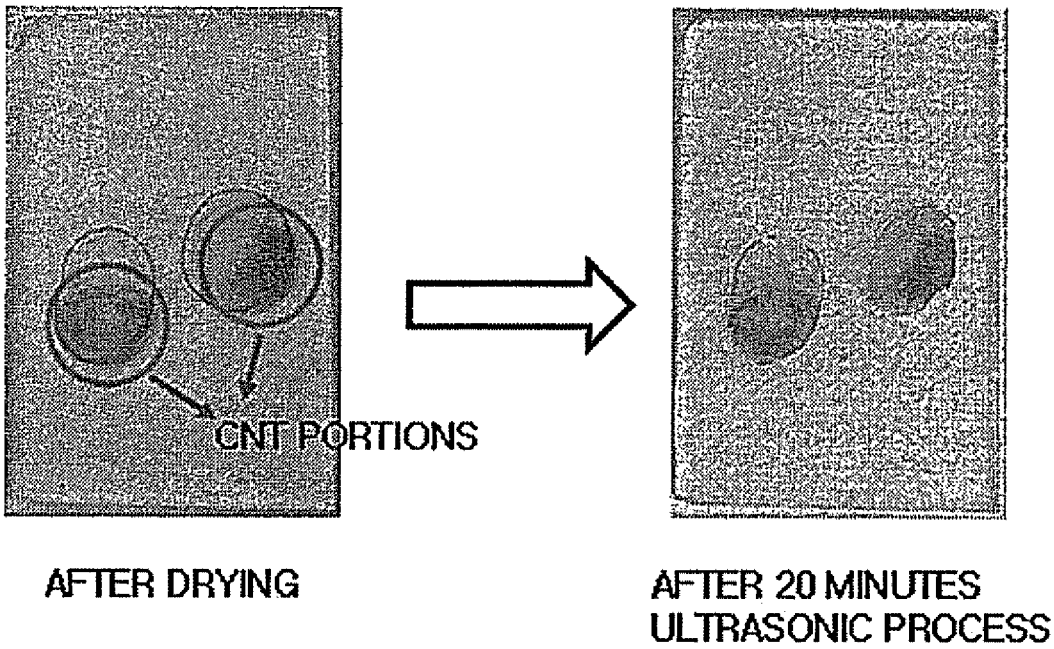
FIG. 4 is a diagram illustrating a test result of adhesion between an exemplary embodiment of nucleic acid-coated CNTs and a substrate.

FIG. 4 is a diagram illustrating the result of the adhesion test between nucleic acid-coated CNTs and an ITO substrate. Referring to FIG. 4, as seen in an optical photograph, most CNTs are not removed and are well attached to the ITO substrate. When the ultrasonic processed sample is activated, e.g., by an adhesive tape, the adhesion test shows the same result as in FIG. 4.

In a manufacture of field electron emitters and field emission tests, in Example 1, 80 mg of a single-wall CNT (Hipco, purity 95%) and 40 mg of tRNA are diluted in 200 ml of deionized water (DI water). The RNA-CNT solution is again centrifugally separated at 5000 rpm (1868 G) and thus non-dispersed CNT bundles are further removed. In order to perform the field emission test, the RNA-CNT solution is sprayed on an ITO substrate and then the ITO substrate is dried at 95° C. During the field emission test, the distance between an anode and a cathode is maintained at 240 μm.

Example 2

In Example 2, the field emission test is performed in substantially the same manner as in Example 1, except that the RNA-CNT solution is sprayed on the ITO substrate, the ITO substrate is dried at 95° C., and then the ITO substrate is further calcinated at 420° C.

In both Examples 1 and 2, field emission is actively generated and the turn on voltage is 0.95 V.

Figure 6:
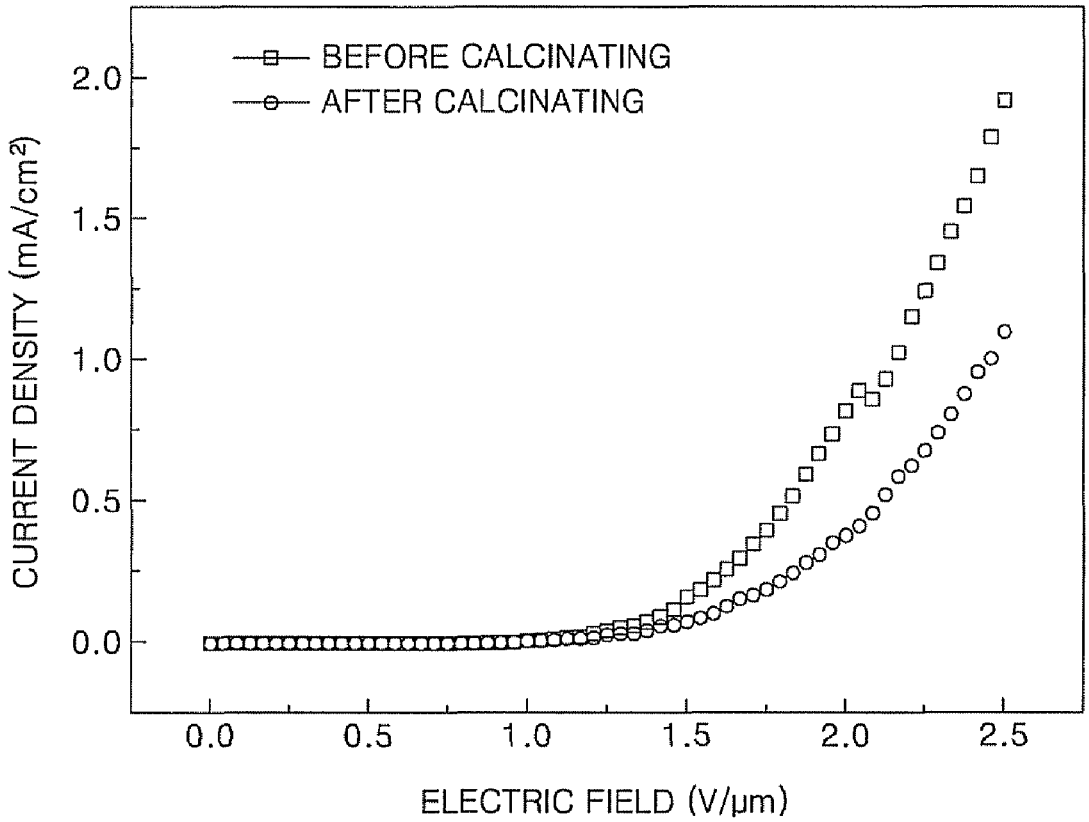
FIG. 6 is a graph illustrating a comparison of field emission tests of an exemplary embodiment of a field electron emitter.

FIG. 6 is a graph illustrating a comparison of the field emission tests of the exemplary embodiments of field electron emitters. Referring to FIG. 6, current density is higher in the sample that is not calcinated and only dried.

Figure 7:
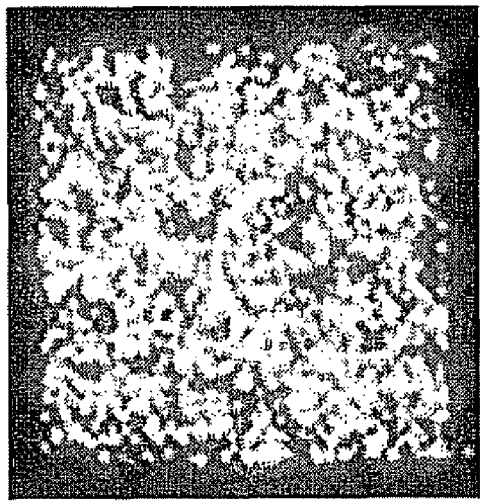
FIG. 7 is an image illustrating field emission of a field electron emitter in which a calcinating process is not performed.
Figure 8:
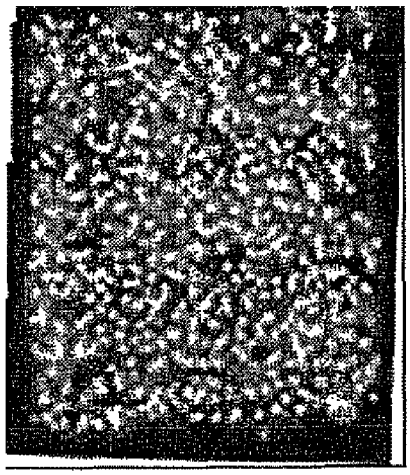
FIG. 8 is an image illustrating field emission of a field electron emitter in which a calcinating process is performed.

FIGS. 7 and 8 are diagrams respectively illustrating field emission of the field electron emitter in which a calcinating process is not performed as in Example 1 and a calcinating process is performed as in Example 2. Referring to FIGS. 7 and 8, the field emission of Example 1, in which a calcinating process is not performed, is greater than that of Example 2.

The method of manufacturing the field electron emitter according to the present exemplary embodiments is simple and the CNTs sprayed on the surface of a masking layer such as a photoresist may be collected and reused while removing the masking layer, thereby reducing a manufacturing cost.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A field electron emitter comprising:

a thin film layer comprising a carbon nanotube disposed on a substrate, wherein the thin film layer comprises nucleic acid, and wherein the nucleic acid is disposed on the carbon nanotubes on a surface of the nanotubes that faces the substrate and where a surface of the carbon nanotubes opposed to the surface that faces the substrate does not contain the nucleic acid and wherein the substrate is a conductive transparent substrate.

2. The field electron emitter of claim 1, wherein at least a portion of the carbon nanotube is coated with the nucleic acid.

3. The field electron emitter of claim 2, wherein the nucleic acid is coated on the carbon nanotube by a π-π stacking interaction between the nucleic acid and the carbon nanotube.

4. The field electron emitter of claim 1, wherein the substrate comprises a material selected from the group consisting of indium tin oxide, aluminum-doped zinc oxide, zinc-doped indium oxide, gallium indium oxide, and any mixtures thereof.

5. The field electron emitter of claim 1, wherein the nucleic acid is deoxyribonucleic acid, ribonucleic acid, pentose nucleic acid, or any mixtures thereof.

6. The field electron emitter of claim 1, wherein the nucleic acid is one of a single-strand nucleic acid and a double-strand nucleic acid.

7. The field electron emitter of claim 1, wherein the nucleic acid is only coated on the carbon nanotube on the interface between the thin film layer and the substrate.

8. A field electron emission device comprising a field electron emitter comprising:

a thin film layer including a carbon nanotube disposed on a substrate, wherein the thin film layer comprises nucleic acid, and wherein the nucleic acid is disposed on the carbon nanotubes on a surface of the nanotubes that faces the substrate and where a surface of the carbon nanotubes opposed to the surface that faces the substrate does not contain the nucleic acid and wherein the substrate is a conductive transparent substrate.

9. A method of manufacturing a field electron emitter, the method comprising:

coating a carbon nanotube aqueous dispersion on a substrate; and drying the coated carbon nanotube aqueous dispersion so that the nucleic acid is disposed on the carbon nanotubes on a surface of the nanotubes that faces the substrate and where a surface of the carbon nanotubes opposed to the surface that faces the substrate does not contain the nucleic acid, wherein the carbon nanotube aqueous dispersion comprises carbon nanotubes and nucleic acid.

10. The method of claim 9, wherein at least a portion of the carbon nanotubes dispersed from the carbon nanotube aqueous dispersion are coated with the nucleic acid.

11. The method of claim 9, wherein the substrate comprises a material selected from the group consisting of indium tin oxide, aluminum-doped zinc oxide, zinc doped indium oxide, gallium indium oxide, and any mixtures thereof.

12. The method of claim 9, wherein the nucleic acid is deoxyribonucleic acid, ribonucleic acid, pentose nucleic acid, or any mixtures thereof.

13. The method of claim 9, wherein the nucleic acid is one of single-strand nucleic acid and double-strand nucleic acid.

14. The method of claim 9, wherein the carbon nanotube aqueous dispersion is manufactured using a method comprising:

adding nucleic acid and carbon nanotube to a solvent to form a solution; and ultrasonic processing the solution in which the nucleic acid and the carbon nanotube are included.

15. The method of claim 14, wherein the nucleic acid and the carbon nanotubes are added by a weight ratio of from about 1:1 to about 1:10.

16. The method of claim 9, further comprising activating a dried carbon nanotube-coated layer, after the drying of the coated carbon nanotube aqueous dispersion.

17. The method of claim 16, wherein the activating a dried carbon nanotube coated layer comprises removing the nucleic acid coated on the carbon nanotube except for the nucleic acid between the carbon nanotube and substrate using an etching process.

18. The method of claim 16, wherein the activating a dried carbon nanotube coated layer comprises a taping process.

19. The method of claim 9, further comprising separating only the nucleic acid-coated carbon nanotube from the carbon nanotube aqueous dispersion, before coating the carbon nanotube aqueous dispersion on the substrate.

20. The method of claim 19, wherein the nucleic acid-coated carbon nanotube is separated by at least one of centrifugation, precipitation and drying.

* * * * *